United States Patent [19]

Hasler et al.

[11] 4,417,898

[45] Nov. 29, 1983

[54] CONTINUOUS DYEING PROCESS WHICH PROVIDES IMPROVED WETFASTNESS: ALKANDLAMINE-CONTAINING DYE LIQUOR AND AFTER-TREATMENT WITH FIXING AGENT

[76] Inventors: Rolf Hasler, Oberwil, Switzerland; Francis Palacin, Riedisheim, France

[21] Appl. No.: 415,852

[22] Filed: Sep. 8, 1982

[30] Foreign Application Priority Data

Sep. 11, 1981 [DE] Fed. Rep. of Germany ..... 3136032

[51] Int. Cl.[3] ..... D06P 3/62

[52] U.S. Cl. ..... 8/543; 8/554; 8/556; 8/604; 8/681; 8/685; 8/918

[58] Field of Search ..... 8/543, 554, 556, 604

[56] References Cited

U.S. PATENT DOCUMENTS 3,141,728 7/1974 Bockmann et al. ..... 8/551

FOREIGN PATENT DOCUMENTS 763071 12/1956 United Kingdom .
763973 12/1956 United Kingdom .
817864 8/1959 United Kingdom .
1396195 6/1975 United Kingdom .
2070006 9/1981 United Kingdom .

*Primary Examiner*—A. Lionel Clingman

[57] ABSTRACT

The invention relates to a process for continuous dyeing a cellulosic fibrous substrate with a direct or reactive dye comprising the steps of (a) applying to the substrate an aqueous dyeing liquor containing an alkanolamine, followed by (b) fixing the dyeings, and finally (c) after-treating the dyed substrate with a fixing agent, the resulting dyeings having improved wet fastnesses.

19 Claims, No Drawings

CONTINUOUS DYEING PROCESS WHICH PROVIDES IMPROVED WETFASTNESS: ALKANDLAMINE-CONTAINING DYE LIQUOR AND AFTER-TREATMENT WITH FIXING AGENT

This invention relates to a process for continuous dyeing a substrate comprising cellulosic fibres with direct or reactive dyes, the resulting dyeings having improved wet fastnesses.

The invention provides a process for continuous dyeing a cellulosic fibrous substrate with a direct or reactive dye comprising the steps of (a) applying to the substrate an aqueous dyeing liquor containing an alkanolamine, followed by (b) fixing the dyeings, and finally (c) after-treating the dyed substrate with a fixing agent comprising a precondensate or mixture of either (A) the product of reacting a mono- or polyfunctional primary or secondary amine with cyanamide, dicyandiamide, guanidine or bisguanidine; or ammonia with cyanamide or dicyandiamide, said product (A) containing reactive hydrogen atoms bound to nitrogen, or (B) a quaternary polyalkylene polyamine containing reactive hydroxy or amino groups with (C) an N-methylol derivative of a urea, melamine, guanamine, triazinone, urone, carbamate or acid amide, optionally together with (D) a catalyst for the crosslinking of N-methylol compounds of the type (C) above.

In step (a) the cellulosic substrate is impregnated with a dyeing liquor by conventional application techniques, preferably by padding. The pick-up is from 50 to 200% preferably from 50 to 100% by weight of the substrate. The impregnation is preferably carried out at room temperature. The direct or reactive dyes which can be used are those known from the Colour Index. Preferred dyes are direct dyes, more preferably metal complex dyes, particularly copper complex dyes, most preferably those mentioned in U.S. patent application Ser. Nos. 347,138 and 305,424.

In addition to the dyes, the dyeing liquor used in step (a) contains an alkanolamine, suitably an aliphatic alkanolamine, particularly an alkanolamine of formula I

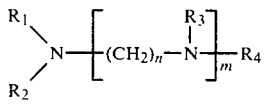

I wherein n is 2 or 3 m is 0 or 1 and each $R_1$, $R_2$, $R_3$ and $R_4$, independently is H, $CH_3$, $C_2H_5$, $—CH_2CH_2CH_2OH$, $—CH_2—CHOH—CH_3$, $—CR_5R_6CH_2OH$ or $—CR_5R_6—CH_2—O—CR_5R_6—CH_2OH$ wherein each $R_5$ and $R_6$, independently is H or $CH_3$ with the proviso that the molecule contains at least one group selected from $—CH_2—CH_2—CH_2OH$, $—CH_2—CHOH—CH_3$, $—CR_5R_6—CH_2OH$ and $—CR_5R_6—CH_2—O—CR_5R_6—CH_2OH$.

Preferred alkanolamines are mono- di- or triethanolamine, diethylethanolamine, n-propanolamine, iso-propanolamine, tri-iso propanolamine, diglycolamine or N-(β-hydroxyethyl)-ethylenediamine or a mixture thereof. A particularly preferred alkanolamine is N-(β-hydroxyethyl)-ethylenediamine, optionally in admixture with one or more alkanolamines as cited above.

The amount of alkanolamine in the dyeing liquor may vary depending on the dye and the desired depth of shade. Suitably the dyeing liquor contains the alkanolamine in an amount from 0.1 to 50 g/liter, preferably from 1 to 10 g/l.

The dyeing liquor used in step (a) may contain further additives such as a hydrotropic agent e.g. an alcohol such as butanol or benzyl alcohol, a glycol such as ethyleneglycol, diethyleneglycol or triethyleneglycol, a glycol ether such as glycol monomethyl ether, glycol monoethyl ether or glycol monobutyl ether, an ester such as glycerine acetate, triethyl phosphate or ethylene carbonate, a heterocyclic compound such as caprolactam, N-methylpyrrolidone or butyrolactone, or an amido group containing compound such as urea, thiourea, dimethylformamide or acetamide. As further suitable additives, the dyeing liquor may contain a wetting agent e.g. a sulphonated succinic acid ester such as the sodium salt of sulphonated dihexyl succinate, or a sulphated glycerol ether such as sulphated dioctylglycerol ether, and/or a thickening agent, e.g. an alginate.

The amount of hydrotropic agent in the dyeing liquor may be up to 200 g/l, preferably up to 80 g/l.

The fixation step (b) may be carried out according to known methods, e.g. at room temperature, preferably from 20° to 30° C., for 8 to 24 hours (pad-batch), at a temperature from 100° to 120° C. with saturated or superheated steam (pad-steam), or at a temperature from 95° to 200° C., preferably from 100° to 150° C., for 1 to 10 minutes, preferably from 1 to 3 minutes (thermofixation) with hot air.

The after-treatment step (c) is suitably carried out with a fixing agent which is a combination of either (A), (C) and (D) or (B), (C) and (D). Such fixing agents, the amount and the after-treatment conditions of the resulting direct or reactive dyeings using these fixing agents are disclosed in U.S. patent applications Ser. Nos. 347,138 and 305,424, the disclosures of which are incorporated herein by reference.

More preferably the dyed cellulosic substrate is padded, after fixation of the dyeings, with a liquor containing a precondensate of (i) the reaction product of diethylene triamine with dicyandiamide, said product containing reactive hydrogen atoms bound to nitrogen, with (ii) dimethyloldihydroxyethyleneurea in the presence of a catalyst for the crosslinking of N-methylol compounds of the type (ii), and then heat cured.

According to a preferred embodiment of the invention, the cellulosic substrate is contacted with a dyeing liquor containing an effective amount of N-(β-hydroxyethyl)-ethylenediamine and, after fixation of the dyeings, preferably direct dyeings, the substrate is after-treated according to the method disclosed in the U.S. Patent Applications cited above, a preferred fixing agent being a precondensate of the compounds (i) and (ii) above in the presence of magnesium chloride as catalyst.

Suitable cellulosic substrates include those comprising natural or regenerated cellulosic fibres, preferably cotton goods.

The process of the invention is a continuous dyeing which gives deep dyeings with improved wet and rubbing fastnesses, particularly fastness to washing, including washing at a temperature from 40° C. to the boil. The resulting dyeings exhibit no bronzing effect even if the dye concentration is increased. At the same time a resin finish is imparted to the cellulosic substrate which gives reduced swelling in aqueous media and hence more rapid drying, improved dimensional stability and higher crease resistance.

The following Examples, in which all parts and percentages are by weight and all temperatures in degrees Centigrade, illustrate the invention.

EXAMPLE 1

A cotton fabric is padded with a liquor containing, per 1,000 parts, 25 parts of the dyestuff C.I. Direct Blue 77 and 5 parts monoethanolamine. The substrate is squeezed out to give a pick-up of 80% and then treated for 60 seconds with saturated steam at 102°. After cold rinsing, the substrate is after-treated according to Examples 13 to 24 of U.S. patent application Ser. No. 347,138. There is obtained a deep blue dyeing with notable wash fastness at the boil.

EXAMPLE 2

By following the procedure of Example 1 but using 30 parts of the dyestuff C.I. Direct Black 62 instead of the 25 parts of the dyestuff C.I. Direct Blue 77, a deep grey dyeing with notable wash fastness at the boil is obtained.

EXAMPLE 3

A cotton fabric is padded with a liquor containing, per 1,000 parts, 40 parts of the dyestuff C.I. Direct Blue 90, 5 parts N-(β-hydroxyethyl)-ethylenediamine and 100 parts urea. The substrate is squeezed out to give a pick-up of 80% and then treated for 60 seconds with saturated steam at 102°. After cold rinsing, the substrate is after-treated according to Examples 13 to 24 of U.S. patent application Ser. No. 347,138. There is obtained a deep blue dyeing having excellent fastness to the wash at the boil.

EXAMPLE 4

A cotton fabric is padded with a liquor containing, per 1,000 parts, 30 parts of the dyestuff C.I. Direct Blue 90, 5 parts N-(β-hydroxyethyl)-ethylenediamine and 100 parts urea. The substrate is squeezed out to give a pick-up of 80% and then rolled up and stored for 8 hours at room temperature. After a cold rinsing, the substrate is after-treated according to Examples 13 to 24 of U.S. patent application Ser. No. 347,138. There is obtained a deep blue dyeing with very good wash fastness at the boil.

EXAMPLE 5

By following the procedure of Example 3 but replacing the 40 parts of the dyestuff C.I. Direct Blue 90 by 25 parts of the dyestuff C.I. Direct Blue 251, a deep blue dyeing with notable wash fastness at the boil is obtained.

EXAMPLE 6

By following the procedure of Example 4 but replacing the dyestuff C.I. Direct Blue 90 by 25 parts of the dyestuff C.I. Direct Blue 251, a deep blue dyeing with notable wash fastness at the boil is obtained.

What is claimed is:

1. A process for continuous dyeing a cellulosic fibrous substrate with a direct or reactive dye comprising the steps of (a) applying to the substrate an aqueous dyeing liquor containing a direct or reactive dye and an alkanolamine, followed by (b) fixing the dyeings, and finally (c) after-treating the dyed substrate with a fixing agent comprising a precondensate or mixture of either (A) the product of reacting a mono- or polyfunctional primary or secondary amine with cyanamide, dicyandiamide, guanidine or bisguanidine; or ammonia with cyanamide or dicyandiamide, said product (A) containing reactive hydrogen atoms bound to nitrogen, or (B) a quaternary polyalkylene polyamine containing reactive hydroxy or amino groups with (C) an N-methylol derivative of a urea, melamine, guanamine, triazinone, urone, carbamate or acid amide, optionally together with (D) a catalyst for the crosslinking of N-methylol compounds of the type (C) above.

2. A process according to claim 1, wherein the dyeing liquor used in step (a) contains an alkanolamine of formula I

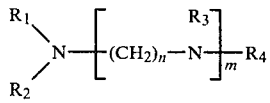

I wherein n is 2 or 3 m is 0 or 1 and each $R_1$, $R_2$, $R_3$ and $R_4$, independently is H, $CH_3$, $C_2H_5$, $—CH_2CH_2CH_2OH$, $—CH_2—CHOH—CH_3$, $—CR_5R_6CH_2OH$ or $—CR_5R_6—CH_2—O—CR_5R_6—CH_2OH$ wherein each $R_5$ and $R_6$, independently is H or $CH_3$ with the proviso that the molecule contains at least one group selected from $—CH_2—CH_2—CH_2OH$, $—CH_2—CHOH—CH_3$, $—CR_5R_6—CH_2OH$ and $—CR_5R_6—CH_2—O—CR_5R_6—CH_2OH$.

3. A process according to claim 1, wherein the alkanolamine is selected from monoethanolamine, diethanolamine, triethanolamine, diethylethanolamine, n-propanolamine, iso-propanolamine, triisopropanolamine, diglycolamine and N-(β-hydroxyethyl)-ethylenediamine, and mixtures thereof.

4. A process according to claim 1, wherein the dyeing liquor used in step (a) contains from 0.1 to 50 g/l of alkanolamine.

5. A process according to claim 1, wherein the aqueous dyeing liquor contains a direct dye.

6. A process according to claim 1, wherein the dyeing liquor used in step (a) contains up to 200 g/l of a hydrotropic agent.

7. A process according to claim 1, wherein the dyeing liquor used in step (a) contains a wetting agent or a thickening agent or a mixture thereof.

8. A process according to claim 1, wherein in step (c) the substrate is after-treated with a precondensate of (i) the reaction product of diethylene triamine with dicyandiamide, said product containing reactive hydrogen atoms bound to nitrogen, with (ii) dimethyloldihydroxyethyleneurea in the presence of a catalyst for the crosslinking of N-methylol compounds of the type (ii), and then heat cured.

9. A process according to claim 1, wherein the catalyst for crosslinking is magnesium chloride.

10. A process according to claim 2 wherein the dyeing liquor used in step (a) contains 0.1 to 50 g/l of alkanolamine.

11. A process according to claim 3 wherein the dyeing liquor used in step (a) contains from 0.1 to 50 g/l of alkanolamine.

12. A process according to claim 3 wherein the alkanolamine is N-(β-hydroxyethyl)-ethylenediamine.

13. A process according to claim 2 wherein the dyeing liquor used in step (a) contains 1 to 10 g/l of alkanolamine.

14. A process according to claim 3 wherein the dyeing liquor used in step (a) contains 1 to 10 g/l of alkanolamine.

15. A process according to claim 10 wherein the dyeing liquor used in step (a) contains a direct dye.

16. A process according to claim 5 wherein the direct dye is a metal complex dye.

17. A process according to claim 14 wherein the dyeing liquor used in step (a) contains a metal complex dye.

18. A process according to claim 14, wherein in step (c) the substrate is after-treated with a precondensate of (i) the reaction product of diethylene triamine with dicyandiamide, said product containing reactive hydrogen atoms bound to nitrogen, with (ii) dimethyloldihydroxyethyleneurea in the presence of a catalyst for the crosslinking of N-methylol compounds of the type (ii), and then heat cured.

19. A process according to claim 15, wherein in step (c) the substrate is after-treated with a precondensate of (i) the reaction product of diethylene triamine with dicyandiamide, said product containing reactive hydrogen atoms bound to nitrogen, with (ii) dimethyloldihydroxyethyleneurea in the presence of a catalyst for the crosslinking of N-methylol compounds of the type (ii), and then heat cured.

* * * * *